US005349939A

United States Patent [19]

Perrone

[11] Patent Number: 5,349,939

[45] Date of Patent: Sep. 27, 1994

[54] SEMI-AUTOMATIC GUN

[75] Inventor: Aldo Perrone, Mississauga, Canada

[73] Assignee: Brass Eagle Inc., Mississauga, Canada

[21] Appl. No.: 929,992

[22] Filed: Aug. 13, 1992

[51] Int. Cl.[5] ..... F41B 11/26; F41B 11/06

[52] U.S. Cl. ..... 124/76; 124/74

[58] Field of Search ..... 124/31, 37, 56, 66, 124/67, 71, 72, 73, 74, 76

[56] References Cited

U.S. PATENT DOCUMENTS

| | | | |
|---|---|---|---|
| Re. 27,568 | 1/1973 | Vadas et al. . | |
| 227,789 | 5/1880 | Hyde | 124/75 |
| 2,817,328 | 12/1957 | Gale . | |
| 3,003,281 | 10/1961 | Butler et al. | 124/67 X |
| 3,177,863 | 4/1965 | Spack . | |
| 3,227,148 | 1/1966 | Spack | 124/76 |
| 3,561,319 | 2/1971 | Joyce et al. | 124/72 X |
| 3,788,298 | 1/1974 | Hale | 124/74 X |
| 3,824,981 | 7/1974 | Crane et al. . | |
| 4,116,193 | 9/1978 | Chiba | 124/72 |
| 4,936,282 | 6/1990 | Dobbins et al. | 124/73 X |
| 5,078,118 | 1/1992 | Perrone | 124/74 |

FOREIGN PATENT DOCUMENTS

| | | | |
|---|---|---|---|
| 1264128 | 1/1990 | Canada . | |
| 3406757 | 8/1985 | Fed. Rep. of Germany | 124/56 |

*Primary Examiner*—Randolph A. Reese
*Assistant Examiner*—John Ricci
*Attorney, Agent, or Firm*—Krass & Young

[57] ABSTRACT

A gun for firing pellets using compressed gas having a breech, a hammer mechanism slidably mounted in the breech, which mechanism includes a hammer and a spring mounted to drive the hammer forwards when the gun is fired, and a trigger pivotally connected to the breech. A sear device having a front and a rear end is mounted on a sear pin in the breech. A sear spring biases the sear device so that the front end thereof pivots downwardly after the hammer is released. This sear device includes a sear detent slidably mounted in the front end. A small spring biases the sear detent to move to a forward position in order to be engageable by the trigger. The valve mechanism of the gun is mounted by a pin about which extends an elastomeric bumper. This bumper reduces shock loading on a top frame of the gun.

14 Claims, 4 Drawing Sheets

SEMI-AUTOMATIC GUN

BACKGROUND OF THE INVENTION

This invention relates to guns and in particular guns suitable for firing pellets using compressed gas.

A variety of air and compressed gas guns are known at this time and they are capable of firing a variety of projectiles including BB's, lead pellets and paint balls. One common type of gun uses small cylinders containing compressed $CO_2$. These metal cylinders have an end that can be punctured in order to release the $CO_2$ gas. Guns of this type have been used for quite some time to fire lead pellets for purposes of game shooting and target shooting and more recently they have been developed and adapted to fire paint pellets. These pellets are in the form of spherical gelatin capsules filled with a marking solution or paint. Guns that fire paint pellets are used in mock "war games" where the users of the guns attempt to hit other game participants with a paint pellet. Protective wear is worn to prevent injury during such games.

Recently issued Canadian patent No. 1,264,128 dated Jan. 2, 1990, and entitled "AIR GUN", describes a gun for firing paint pellets wherein a hammer mechanism is mounted in a rear end of the pellet-firing barrel. The gas cylinder for this gun is mounted in an upper barrel directly above and parallel to the pellet-firing barrel. This known gun has a gas valve system arranged in the lower barrel in front of the hammer. The gun is fired by a trigger mechanism that includes a trigger and a pivoting trigger operated lever, the rear end of which is lowered by pressing the trigger. The lever rear end is returned to its original position by a spring after release of the trigger. The lever has an upstanding projection on its rear end which engages in an annular groove that extends about the hammer.

Another paint ball firing gun that employs compressed gas is shown in applicant's U.S. Pat. No. 5,078,118 dated Jan. 7, 1992. In this air gun, there is a housing or "donkey" mounted at the rear end of the breech, which housing is used to attach the standard gas cylinder to the rear end of the breech. This housing includes a gas passageway for delivering compressed gas from the cylinder to a small passageway extending along the top of the breech. A barrel is attached to the front end of the breech by a standard thread connection.

One difficulty with many known guns is that they must be made from relatively expensive, metal parts in order that the gun will have the necessary strength to withstand the loads thereon, including shock loads. Also, some pares must be machined to fairly close tolerances in order to work properly and in a reliable fashion. It will be appreciated that machined metal parts can increase the cost of a gun substantially and it is therefore desirable to avoid the need for such parts where possible. It is also desirable to reduce the number of parts required for the operation of an air gun, again in order to reduce costs.

It is an object of the present invention to provide a gun which is self-cocking and which employs a relatively simple and reliable sear mechanism capable of releasing the hammer with each pull of the trigger.

It is a further object to provide a unique pin connection for mounting the valve mechanism of an air gun in its breech. The pin connection includes an elastomeric bumper which reduces shock loading on the frame of the gun, thus permitting the frame to be made from an inexpensive material such as plastics.

It is an additional object of the invention to provide a gun for firing pellets that has a unique housing or "donkey" for holding a source of compressed gas detachably connected to the rear portion of an exterior frame that forms the breech. This housing is connected by means of pins which enable the housing to be easily connected and disconnected from the rest of the gun.

There is disclosed herein an inexpensive gun wherein the breech is made from top and bottom frames which are detachably connected together by retaining pins. This frame construction can quickly and readily be disassembled.

SUMMARY OF THE INVENTION

According to one aspect of the invention, a gun has a breech and a hammer mechanism slidably mounted in the breech, this mechanism including a hammer and a spring mounted to drive the hammer forwards in the breech when the gun is fired. A trigger with a rearwardly projecting cam is pivotally connected to the breech and there are means for pivoting the trigger to a forward position upon release of the trigger. A sear pin is mounted in the breech and extends through a hole in a sear device having a front and a rear end. The sear device, which is pivotable about the sear pin, is biased, such as by a spring, so that the front end thereof pivots downwardly after the hammer is released by the sear device. The sear device includes a sear detent slidably mounted in the front end thereof and means, such as a spring, biases the sear detent to move to a forward position in order to be engageable directly by the cam on the trigger. The sear detent is forced rearwardly by direct engagement with the trigger in its pulled, rearward position.

According to another aspect of the invention, a gun for firing pellets using compressed gas has a breech comprising a plastic top frame, a bottom frame connected to the top frame and a tube mounted in a chamber formed by these two frames. The tube contains a gun hammer and extends from a rear portion of the breech to a forward portion thereof. A valve mechanism for controlling the release of the compressed gas has a first portion thereof fixedly mounted in a forward portion of the tube and a second portion projecting out of an opening in a side of the tube. There are also means for mounting the tube and the valve mechanism in the chamber, which means include a pin fixedly connecting the second portion of the valve mechanism to the top frame and an elastomeric bumper extending around the pin. This bumper reduces shock loading of the top frame when the gun is fired.

According to a further aspect of the invention, a gun for firing pellets using compressed gas has a breech comprising an exterior frame containing an elongate chamber and a main tube mounted in this chamber and containing a hammer. The tube extends from a rear portion of the frame to a forward portion thereof. A valve mechanism is mounted in the forward portion of the tube and transfer means are provided to deliver compressed gas from the rear portion of the frame to the valve mechanism. There is also a housing for holding a source of compressed gas, this housing being connectible to the transfer means. Pin means detachably connect the housing to a rear portion of the breech.

Further features, aspects and advantages of the present invention will become apparent from the following detailed description of a preferred embodiment taken in conjunction with the accompanying drawings.

It will be understood that certain features of the present gun are known, having been used in earlier compressed gas guns made by the applicant. As indicated above, one of these air guns is described in detail in applicant's Canadian patent No. 1,264,128, the specification of which is incorporated herein by reference.

Figure 1:
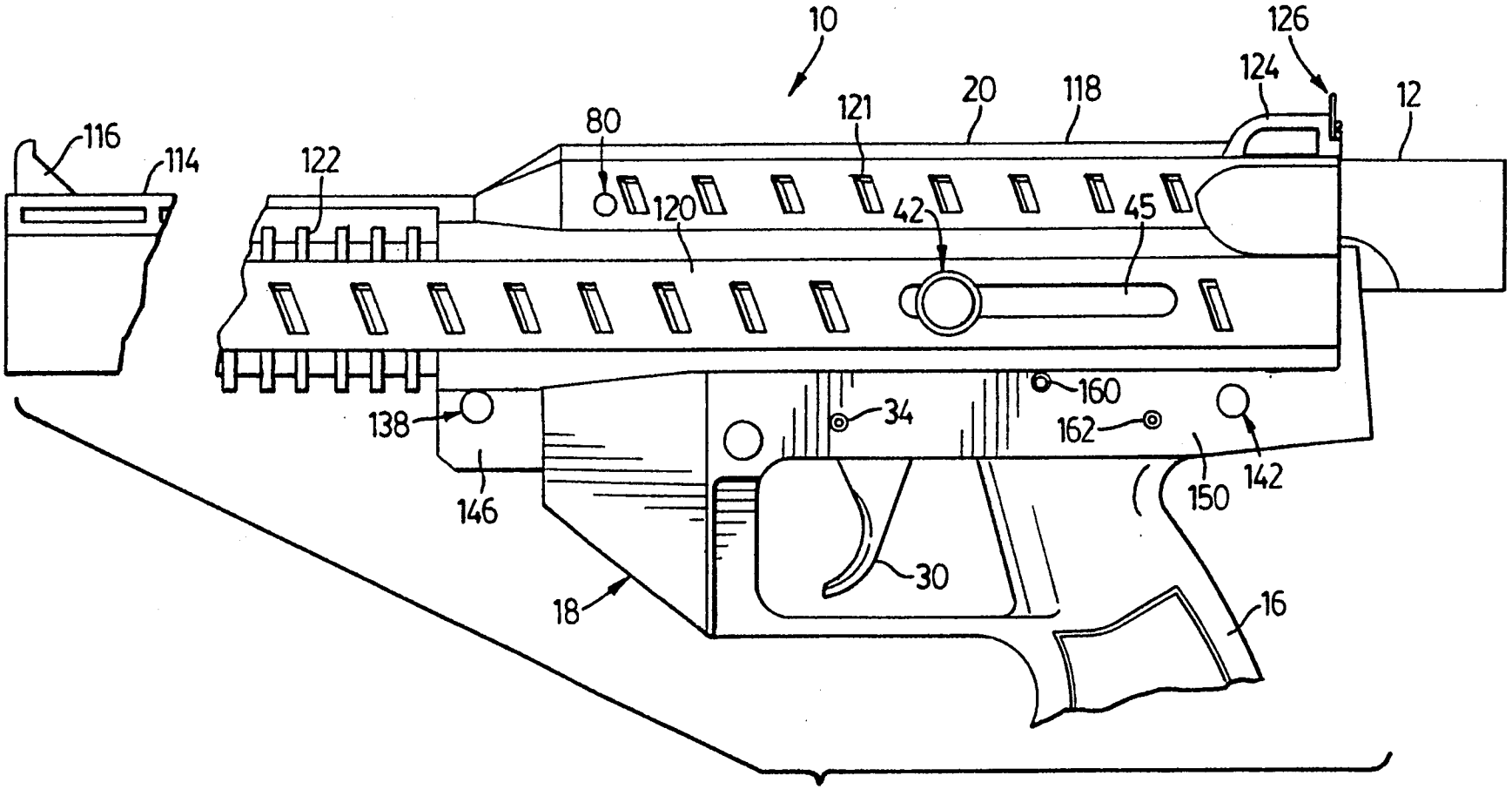
FIG. 1 is a side elevation of a gun for firing paint pellets constructed in accordance with the invention with portions of the gun omitted for ease of illustration.
Figure 2:
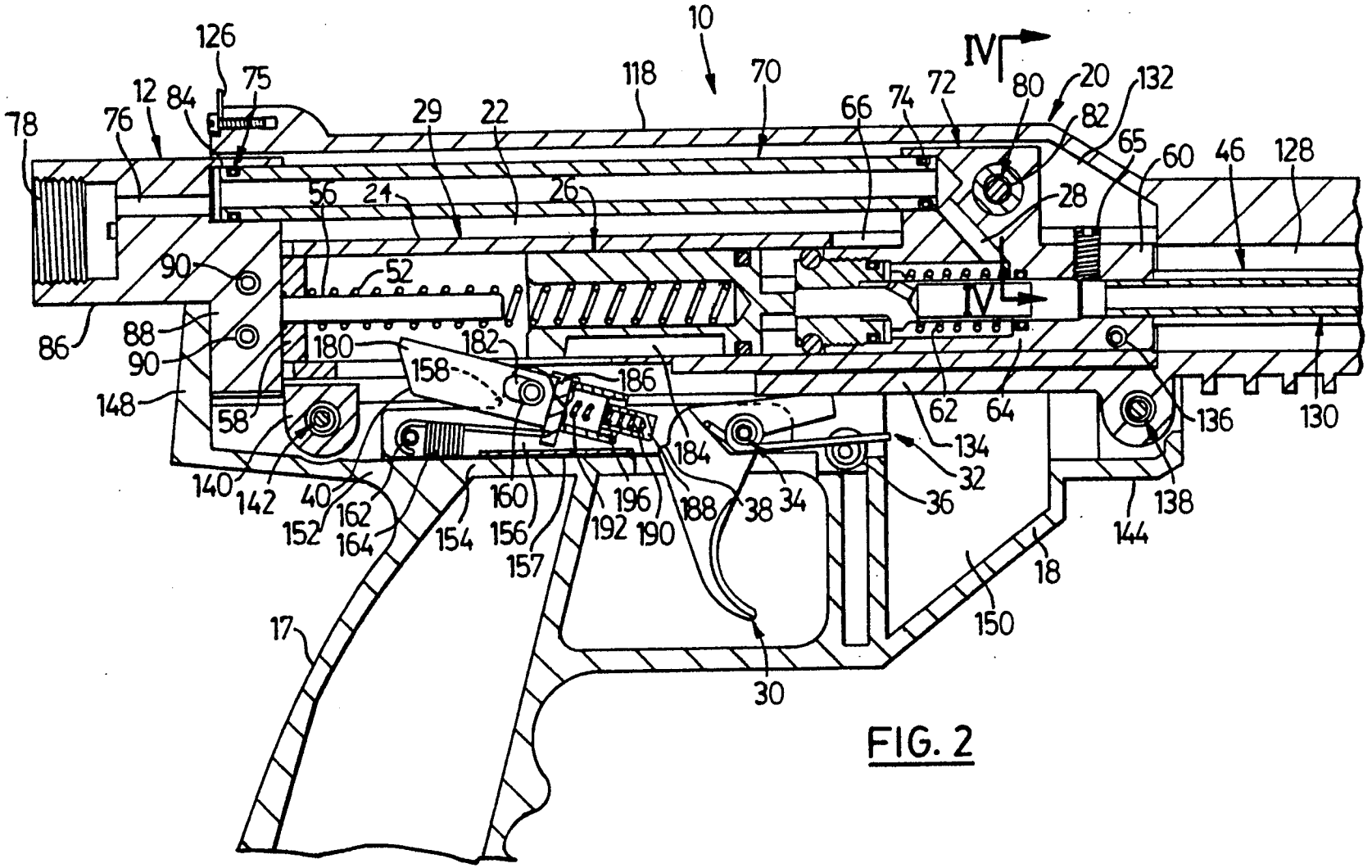
FIG. 2 is a cross-sectional elevation taken along the longitudinal centre line of the gun and showing a rear portion of the gun.
Figure 3:
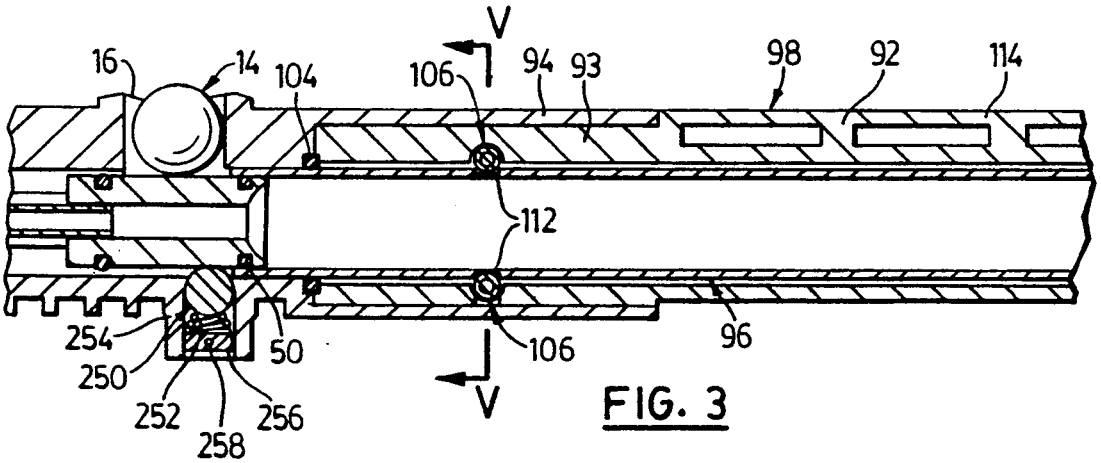
FIG. 3 is a cross-sectional elevation of the central portion of the gun of FIGS. 1 and 2, which view shows a portion of the barrel including a shroud.

A preferred embodiment of a gun 10 constructed in accordance with the present invention is shown in FIGS. 1 to 3 of the drawings. This gun employs a standard $CO_2$ cylinder (not shown) which is attached by means of a housing or donkey 12 detachably connected to the rear end of the gun. The illustrated gun is adapted to fire paint pellets 14 of known construction, which pellets enter the gun through an opening 16 shown in FIG. 3. The gun 10 is held by means of a standard gun handle 17 which can be an integral part of a bottom frame 18 made of a plastics material such as fibreglass filled nylon. The bottom frame 18 is detachably connected to a top frame 20 which can be made of the same plastics material. The top frame and bottom frame together form a major part of the breech of the gun. The frames 18 and 20 together form a chamber 22 in which is mounted an elongate tube 24. The tube contains a gun hammer 26 and extends from a rear portion of the breech or frame to a forward portion thereof. It will be understood that the tube forms a main longitudinal passageway in the breech with an opening at its front end for the release of compressed gas when the gun is fired. There is also a second opening 28 in the side of the tube for entry of compressed gas into the passageway formed by the tube.

The gun 10 is fired by means of a trigger mechanism 30, which mechanism includes a trigger pivotally mounted to a lower portion of the breech. There are means for pivoting the trigger to a forward position upon release of the trigger. In the illustrated preferred embodiment, the pivoting means includes a trigger spring 32 which extends about a trigger pin 34. It will be appreciated that the term "trigger mechanism" as used herein includes not only the trigger member per se but also an associated pin (or pins) and other associated members or parts that work with the trigger to operate a sear device. In order to fire the gun, one must move a safety 36 to the fire position. The rear edge of the illustrated trigger, near the top thereof is formed with a trigger cam 38 which is designed to engage a unique sear device 40, the construction of which is explained in more detail hereinafter.

The gun 10, which is a semi-automatic, is loaded initially by pulling back on an outwardly projecting knob 42. The knob 42 is connected by a threaded pin 44 to the hammer 26. The pin 44 extends through a slot 45 formed in the side of the exterior frame. The pin 44 is also connected to the rear end of a transfer link or rod 46 which has a 90 degree bend at its front end. The front end of the rod is connected by means of pin 48 to a bolt 50. The pin 48 extends into a small opening formed in the rear surface of the bolt. This pin-type connection avoids the need for a threaded connection between the rod and the bolt or the need for a screw which might become loose. It will be appreciated that by pulling back on the knob 42, one not only cocks the hammer but one also draws back the bolt to permit a paint ball to drop through the opening 16 and into the barrel of the gun. The hammer and bolt must be driven back against the force of a hammer spring 52 which extends longitudinally in the tube and into a central passageway 54 formed in the hammer. The rear end of the spring is supported by spring guide 56 which extends along the central axis of the tube at the rear thereof. Rearward movement of the hammer is cushioned by a ring-shaped bumper 58 made of a suitable elastomeric material such as rubber. This bumper extends around the rear end of the guide 56 and supports this guide by means of a press fit. The guide 56 is formed with a head 57 at its rear and this head is sandwiched between the bumper and the front of the donkey 12.

Fixed in the tube 24 is a valve body 60 which is part of a gas valve system arranged in front of the hammer mechanism. The system includes a sealed gas passageway 62 connected to the opening 28. The gas valve system is constructed to release compressed gas in order to fire a paint pellet when the hammer mechanism is released. It is constructed generally along the lines described and illustrated in the abovementioned Canadian patent No. 1,264,128 except for the manner in which the compressed gas is delivered to the gas passageway 62. In the gun 10 the valve body 60 has a first portion 64 thereof fixedly mounted in the forward portion of the tube 24. This first portion can be fixed by means of a screw 65. The valve body also has a second portion projecting out of an opening 66 in one side of the tube. The aforementioned opening 28 extends through this second portion. Extending rearwardly from this second portion is a passage means in the form of tube 70 which supplies compressed gas from the housing 12 to the second portion 72 of the valve body. The front end of the transfer tube 70 has a seal 74 extending about its circumference, which seal engages the cylindrical wall of a hole formed in the rear of the second portion. Another gas seal 75 extends around the rear end of the tube 70, which rear end fits into the aforementioned housing 12. A short gas passageway 76 extends through the housing 12 and opens into the rear end of the tube 70. A threaded opening 78 is formed in the rear end of the housing 12 to receive the threaded end of a compressed gas cylinder. It will be understood that when the end of the cylinder is inserted into the opening 78, the end of the cylinder is pierced in a known manner to allow the compressed gas to flow through the housing and into the tube 70.

Figure 4:
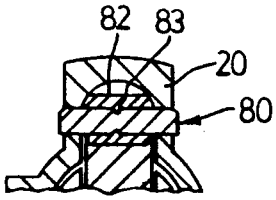
FIG. 4 is a cross-sectional view taken along the line IV—IV of FIG. 2.

The unique manner in which the valve body 60 and the front end of the tube is mounted in the frame of a gun will now be described with particular reference to FIGS. 2 and 4 of the drawings. The mounting mechanism includes a pin 80 which extends through two vertical side walls of the top frame 20 and through the second portion 72 of the valve body in order to fixedly connect same. A tube shaped elastomeric bumper 82 extends around the pin and is located in the opening formed in the valve body. A small rib 83 extends about the interior of the bumper and fits into a groove extending about the centre of the pin 80. The engagement between the rib and the groove prevents the pin from coming out of its opening unless driven out. It will be appreciated that the advantage of this type of pin connection is that the bumper reduces shock loading on the plastic top frame when the gun is fired. Shock loading will occur when the hammer hits the valve stem and also when the hammer hits the rear bumper 58. By reducing the effect of shock loading on the frame, the frame can be made of a relatively inexpensive plastic, such as fibreglass filled nylon, rather than a metal.

In order that the second portion will be held firmly in place, the hole or opening in the second portion for the pin and bumper should have a width sufficient to snugly accommodate the pin with the bumper thereon as illustrated.

As indicated, the housing or donkey 12 is mounted at the rear end of the exterior frame. Formed in the front of the housing is a cylindrical opening 84. The rear end of the tube 70 is connected to the housing by insertion into this opening. The housing 12 includes a rear housing portion 86 that projects rearwardly from the rear end of the frame and a downwardly extending connecting portion 88 positioned inside the rear portion of the bottom frame 18. Pin means that extend through this connecting portion 88 are used to detachably connect the housing to the rear portion of the tube 24. The pin means preferably comprises two pin members 90 located one above the other. It will also be noted that the connecting portion 88 of the donkey supports the elastomeric bumper 58 which rests against it. Again, by using the pins 90, easy assembly of the donkey housing 12 to the rear of the tube 24 is permitted and it is not necessary to employ a threaded connection.

Detachably connected to the front end of the breech is a barrel 92. A rear section 93 of the barrel telescopes into a front section 94 of the breech to form the connection between them. The barrel comprises two major components, these being an inner metal tube 96 and an outer shroud 98 which can be made of plastics material, such as fibreglass filled nylon. It will be appreciated that the metal tube provides the necessary strength to the barrel while the plastic shroud protects the metal tube and adds to the overall strength of the barrel. The rear section of the barrel, in the illustrated embodiment is formed with lengthwise extending ribs 100 (see FIG. 5) while the front section of the top frame is formed with cooperating grooves 102 which snugly accommodate the ribs. Thus, the engagement between the ribs and the grooves prevents undesired rotation of the barrel relative to the breech or top frame. Located at the very rear end of the shroud 98 is an O-ring 104 made of compressible material such as rubber. An annular groove is formed on the inside of the front section of the top frame to accommodate this O-ring. This O-ring acts to remove any looseness or play between the rear end section of the barrel and the frame into which it is inserted.

Figure 5:
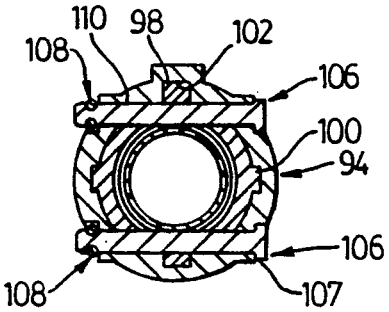
FIG. 5 is a cross-sectional elevation showing how the barrel is connected to a top frame of the gun, said view being taken along the line V—V of FIG. 3.
Figure 6:
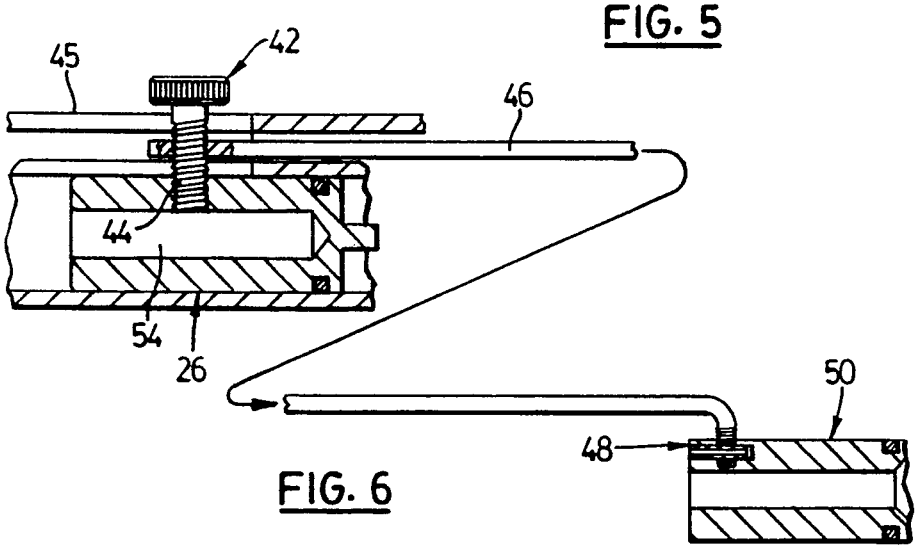
FIG. 6 is a horizontal cross-section illustrating how the hammer of the gun of FIG. 1 is connected to the bolt.

In order to prevent longitudinal movement between the barrel and the frame, pin means are used which, in the illustrated preferred embodiment, comprise two pin members located in two transverse passageways extending through the front section of the breech and the rear section of the barrel. These pin members 106 are best seen in FIG. 5 of the drawings. Each pin member is formed with a head 107 at one end and a small groove at the opposite end to accommodate a small O-ring or retaining ring 108. If the member 108 is an O-ring, it is made of compressible material which, in an uncompressed state, has a diameter greater than that of the transverse passageway 110 that extends through the end of the barrel and the frame. However, each O-ring 108 can be compressed sufficiently, when desired, in order to permit removal of its respective pin member 106. One should also note from FIG. 3 that two shallow grooves 112 are cut into opposite sides of the metal tube 96 near its rear end. One side of each pin member 106 extends into a respective groove as shown in FIG. 3. By this arrangement, it will be appreciated that the pin members 106 prevent relative longitudinal member of all three parts, that is the shroud 98, the inner tube 96 and the top frame. It will be appreciated that instead of the two pin members and transverse passageways shown in FIG. 5, one could instead employ a single retaining pin to prevent longitudinal movement. Also, if desired and in order to make the gun light in weight, the inner tube 96 can be made from aluminum or a suitable lightweight alloy thereof. The shroud 98 can be formed with an upper rib structure 114 and, at the front end of this rib structure, there can be provided an integrally molded blade sight 116. It will be appreciated that the front sight is always held in the proper, upright position due to the aforementioned ribs 100 and grooves 102 which prevent rotation of the shroud relative to the exterior frame of the gun.

Although the illustrated gun shows the rear section of the barrel fitting inside the front section of the frame, a reverse telescoping arrangement could also be used. In other words, a front section of the frame could telescope within a rear section of the barrel. Similarly, although the illustrated version shows the ribs formed on the exterior of the barrel, the ribs could instead be formed on the exterior of the front section of the frame and these ribs would then fit into grooves formed in the rear section of the barrel.

The construction of the plastic top frame 20 will now be described with particular reference to FIGS. 1 to 3 of the drawings. The top frame includes an integrally molded horizontal top 118 and two opposite side walls 120. If desired, the side walls can be formed with spaced apart, decorative grooves 121 and spaced, parallel ribs 122. Also, integrally molded to the rear end of the top frame is a rear sight support 124 to which is connected a rear sight 126. The front section of the top frame is formed with a longitudinal passageway 128 through which extends the aforementioned rod 46 and a hollow bolt guide 130. The passageway 128 opens into a larger chamber 132 which accommodates the aforementioned tube 124 and the smaller tube 70. The chamber is closed at the bottom by bottom wall 134. At the front end of this bottom wall is a connecting lug 136 through which projects a frame pin 138 used to connect the front section of the top frame to the bottom frame 18. Located near the rear end of the top frame is a rear lug 140 which is used to connect the rear end to the bottom frame by means of retaining pin 142. Located between the lug 140 and the bottom 134 is an opening through which the sear device 40 extends.

Turning now to the construction of the bottom frame 18 which is shown in FIGS. 1 and 2, this frame includes a front extension 144 which forms a front cavity located between two side walls 146, this cavity accommodating the aforementioned lug 136. The bottom frame also includes a rear wall 148, the top section of which provides support for the donkey or housing 12. Extending between the rear wall 148 and the front extension 144 are two spaced apart side walls 150, which can be strengthened with internal ribs if desired, and the ends of the aforementioned retaining pin 142 extend through these side walls. Connecting the two side walls is a bottom wall 152 and a central partition 154 located at the top of the handle 16. Rigidly mounted to each side wall 150 is a metal reinforcing plate 156. These two flat elongate plates are formed with an upwardly projecting lug indicated in dashed lines in FIG. 2. The two lugs 158 support a sear pivot pin 160 at each end thereof. The sear 140 is pivotally mounted on this pin. The two reinforcing plates also provide rigid, strong support for the aforementioned trigger pin 34 and another pin 162 that holds one end of a sear spring 164. As indicated by FIG. 1, all three pins, that is the trigger pin 34, the sear pivot pin 160 and the pin 162 extend through both reinforcing plates so as to hold these plates in position, and through the adjacent side walls 150. The two metal plates which can be made of steel, are located on opposite sides of the sear and the trigger mechanism. They can be spaced from the side walls 150 by the aforementioned internal ribs. The advantage of the reinforcing plates 156 is that they act to spread the shock loading of the hammer engaging the sear device 40 and, by so doing, they permit a plastics material to be used for the bottom frame instead of a metal, such as steel or aluminum. In a preferred embodiment, the plates 156 are integrally connected to each other by horizontal connecting web 157 located adjacent to the partition 154.

Turning now to the special sear device 40 used in the gun 10 of the invention, this device has a front end that is engageable by the rigger 30 and a rear end 180. This sear device is pivotable about the aforementioned sear pin 160 which extends through a hole 182 which is elongate in the longitudinal direction of the sear device. Thus, the sear device is able to move a short distance in the longitudinal or lengthwise direction thereof relative to the sear pin and the breech. It will be understood that when the gun is cocked, the rear end 180 of the sear projects into the bottom recess 184 formed in the hammer and holds the hammer in a rearward position until the gun is fired by pulling the trigger.

There are means for biasing the sear device 40 so that its front end pivots downwardly (as viewed in FIG. 2) after the hammer is released. The preferred form of biasing means is the aforementioned sear spring 164 connected at its front end to a connecting pin 186 that extends transversely across the sear through a suitable hole in the sear. Its rear end is connected to the breech by means of the pin 162.

The sear device includes a sear detent 188 slidably mounted in the front end thereof. This detent has a central longitudinal passageway 190 formed therein, which passageway is open at its rear end and accommodates a portion of a small coil spring 192. This spring is accommodated in a longitudinally extending hole in the forward section of the sear. An externally threaded nut 196 provides means for holding the rear end of the sear detent in this hole. The detent is captured in the hole by reason of its wide rear end having a width equal approximately to the width of the hole in the front of the sear.

The sear detent is engaged by the trigger cam 38 formed in the upper rear corner of the trigger. The operation of the sear device and its engagement with the trigger cam will now be explained with reference to FIGS. 2, 7 and 8 of the drawings. FIG. 2 shows the position of the sear device 40 in the uncocked position with the hammer in the forward position. In this position, the sear device 40 is pulled to the left and its front end is pulled downwardly by the sear spring 164. It will be noted that in this position, the pivot pin 160 is located at its forwardmost position in the hole 182. With the trigger pivoted to its forwardmost position, the sear detent 188 projects out of the front end of the sear to the maximum extent. In this position, there is rotational clearance between the front end of the detent and the trigger cam. Thus independent rotation of the trigger relative to the sear device is possible, but it will be appreciated that the trigger is biased to rotate in the counterclockwise direction (as shown in FIG. 2) by the spring 32.

Figure 7:
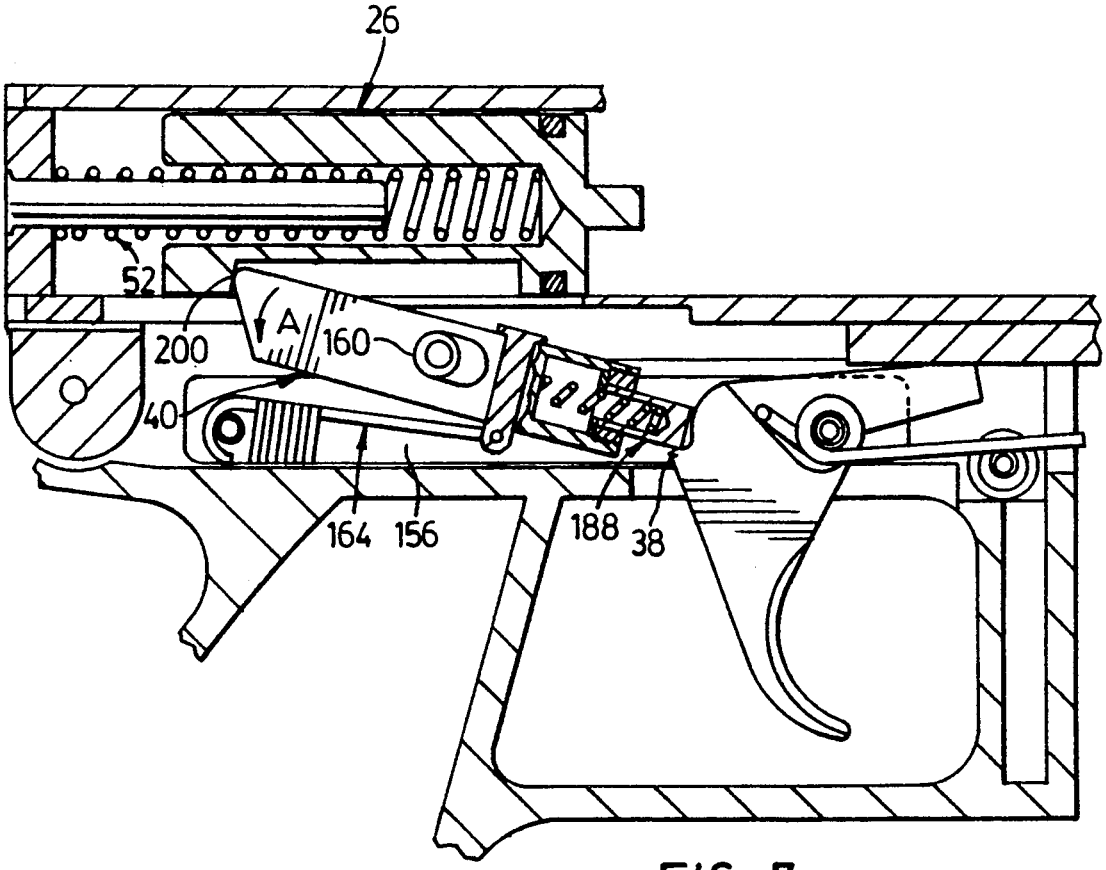
FIG. 7 is a detailed view in cross-section illustrating the position of the sear device and the trigger when the sear device has been forced to the right by the hammer so that a detent in the forward end of the sear is engageable by a cam formed on the trigger.

FIG. 7 of the drawings illustrates the position of the sear device and trigger when the hammer has been cocked. In this position, the rear end of the sear device engages an inner shoulder 200 formed by the recess in the hammer. This engagement causes the sear device 40 to be moved forwardly relative to the sear pin 160. It will be appreciated that this movement is due to the fact that the hammer spring 52 is stronger than the sear spring 164. The forward movement of the sear device creates rotational interference between the trigger cam 38 and the sear detent 188. It will thus be seen that with this arrangement, pulling the trigger will cause the sear device 40 to be pivoted about the pin 160. The rear end of the sear device is pivoted downwards in the direction of the arrow A and out of engagement with the hammer 26.

Figure 8:
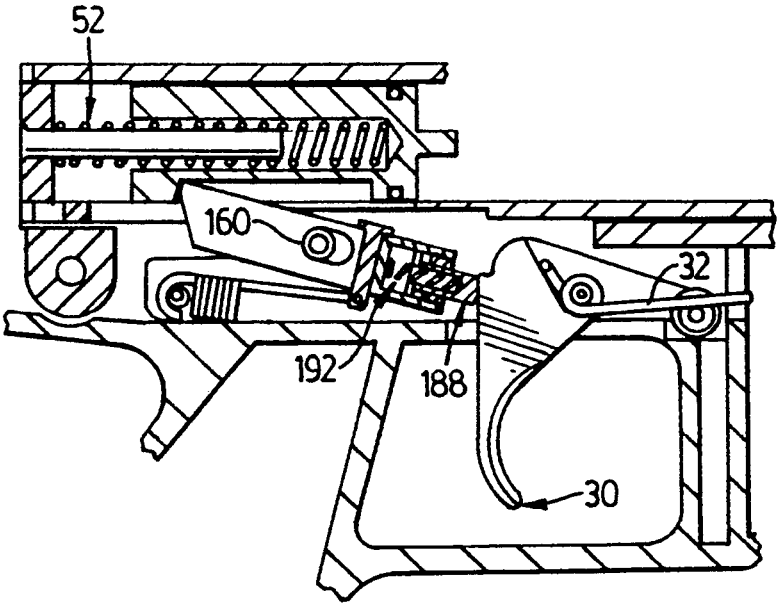
FIG. 8 is a cross-sectional detail similar to FIG. 7 but showing the position of the sear device after the trigger has been pulled, the sear detent being pushed rearwardly by the cam on the trigger.

FIG. 8 illustrates the position of the sear device when the hammer has been cocked as a result of the gun being fired, this figure showing the trigger at its rearward position. Again, in this position, the strong spring 52, by reason of the engagement between the sear device and the hammer, forces the sear device forwardly or to the right, thus the pivot pin 160 is located at the rear end of its hole. This movement causes the detent 188 to be pushed against the cam on the rear of the trigger. Since the trigger cam does not move, the detent slides to the left against the force of the spring 192. Because the detent moves rearwardly, the trigger 30 is free to be pivoted by the trigger spring 32 and thus pivots counterclockwise as seen in FIG. 8. When the trigger is released and moves to its forward position, the trigger cam will clear the detent and the sear detent 188 is immediately pushed forwardly and out of the front end of the sear device by its spring. It will thus be appreciated that the sear device and trigger have returned to the position shown in FIG. 7 and the gun is ready to be fired again.

Mounted below the hole in the frame for the passage of the paint balls is a detent ball 250 which is biased upwardly towards the position shown by means of a coil spring 252. The ball and spring are held in a downwardly extending tube 254 by means of a cap 256. The cad is held in position by means of a small detent pin 258 that extends into the cap. The purpose the detent ball is to hold a paint ball in the rear of the barrel and in front of the bolt when the gun has been cocked.

It will be appreciated by those skilled in the art that various modifications and changes could be made to the compressed gas gun of this invention without departing from the spirit and scope of this invention. Accordingly, all such modifications and changes as fall within the scope of the appended claims are intended to be part of this invention.

I therefore claim:

1. A gun for firing pellets or balls using compressed gas comprising:

an elongate breech having a front end, a rear end, a main longitudinal passageway with a first opening at its front end, and a second opening in the side of said passageway for entry of compressed gas into said passageway;

passage means for supplying compressed gas from a source thereof to said second opening;

a gun handle connected to said breech;

a barrel through which said pellets or balls are fired connected to said front end of said breech;

a hammer mechanism, including a hammer slidably mounted in said passageway and a spring biasing said hammer to move to a forward position in said passageway;

a gas valve system arranged in said passageway in front of said hammer mechanism, said system including a sealed gas passageway connected to said second opening and being constructed to release compressed gas in order to fire a pellet or ball when said hammer mechanism is released;

a trigger pivotally mounted to a lower portion of the breech, said trigger having a rearwardly projecting cam;

means for pivoting said trigger to a forward position upon release of the trigger; and means for releasing said hammer when said trigger is pulled, said releasing means including a sear having a front end, a rear end and an elongate hole extending transversely therethrough, a sear pin mounted in said breech and extending through said elongate hole, means for biasing said sear so that the front end thereof pivots downwardly when said hammer is released, a sear detent slidably mounted in the front end of said sear, and means for biasing said sear detent to move to a forward position relative to said sear;

wherein said sear can pivot about said sear pin and slide longitudinally thereon, said sear detent is engaged directly by said cam on said trigger so that said rear end of said sear is pivoted downwards and out of engagement with said hammer when the trigger is pulled, said detent is forced rearwardly by direct engagement with said trigger in its pulled position, and said detent moves forwardly by the action of said detent biasing means when said trigger is released so that said trigger can reengage said sear and sear detent in order to fire said gun again.

2. A gun according to claim 1 wherein said means for biasing said sear is a first coil spring connected at one end to a forward section of the sear and at its other end to said breech and said means for biasing said sear detent is a second coil spring mounted in a longitudinally extending hole in said forward section of the sear.

3. A gun according to claim 2 wherein said sear detent is elongate and has a central longitudinal passageway formed therein, said detent passageway being open at its rear end and accommodating a portion of said second coil spring, and wherein said sear has means for holding a rear end of said sear detent in said longitudinally extending hole.

4. A gun according to claim 1 wherein the cam on said trigger forms an upwardly facing shoulder which engages under said sear detent when said trigger has moved to its forward position and said means for pivoting said trigger is a trigger spring.

5. A gun having a breech, a hammer mechanism slidably mounted in said breech, said hammer mechanism including a hammer and a spring mounted to drive said hammer forwards in said breech when the gun is fired, a trigger pivotally connected to said breech, said trigger having a rearwardly projecting cam, means for pivoting said trigger to a forward position upon release of said trigger, an elongate sear device having a front end and a rear end, a sear pin mounted in said breech and extending through a hole in said sear device, the latter being pivotable about said sear pin, and means for biasing said sear device so that said front end thereof pivots downwardly after said hammer is released by said sear device, wherein said sear device includes a sear detent slidably mounted in the front end of the device and means for biasing said sear detent to move to a forward position in order to be engageable directly by said cam on said trigger and wherein said sear detent is forced rearwardly by direct engagement with the trigger in its pulled, rearward position.

6. A gun according to claim 5 wherein said means for biasing said sear device is a first coil spring connected at one end to a forward section of the sear device and at its other end to said breech and said means for biasing said sear detent is a second coil spring mounted in a longitudinally extending hole in said forward section of the sear device.

7. A gun according to claim 5 wherein said cam on the trigger forms an upwardly facing shoulder which engages under said sear detent when said trigger has moved to its forward position.

8. A gun according to claim 5 wherein the hole in said sear device is elongate in the longitudinal direction of the device, whereby said sear device is able to move a short distance in the longitudinal direction of the sear device relative to the sear pin and the breech.

9. A gun for firing pellets or balls using compressed gas comprising:

a gun frame including a breech and a gun handle;

means for supplying compressed gas to said breech;

a barrel mounted at a front end of said breech;

a hammer slidable in said frame from a cocked position to a firing position;

a pivotably mounted trigger and means for pivoting said trigger to a forward position upon release of the trigger;

a gas valve system adapted to release compressed gas through said barrel in order to fire a pellet or ball, said valve system including a valve body mounted in said breech and having an opening communicating with said gas supply means for entry of compressed gas into said valve body;

a spring biasing said hammer to move in a direction towards said valve body;

release means for releasing said hammer to said firing position when said trigger is pulled and causing said valve system to release a suitable amount of compressed gas out of a second opening disposed for firing said pellet or ball out of said barrel, said release means including a sear having first and second ends, said second end being engageable with said hammer in said cocked position, a sear pin on which said sear is pivotably mounted, means for biasing said sear so that said sear is pivoted in a desired direction about said sear pin when the gun is fired, a sear detent slidably mounted in said first end of said sear, and means for biasing said sear detent to move away from said sear in the direction of said first end thereof, wherein said sear detent is engaged directly by said trigger so that said second end of said sear is pivoted downwards when the trigger is pulled, thus actuating said release means, said detent being pushed towards said sear in the direction of said second end thereof by direct engagement with said trigger in its pulled position and moving in the direction of said first end by the action of said detent biasing means when said trigger is released.

10. A gun according to claim 9 wherein said means for biasing said sear is a first coil spring connected at one end to the sear and at its other end to said breech and said means for biasing said sear detent is a second coil spring mounted in a longitudinally extending hole in said first end of the sear.

11. A gun according to claim 9 wherein said trigger is formed with an upwardly facing shoulder which engages under said sear detent when said trigger has moved to its forward position and said means for pivoting said trigger is a trigger spring.

12. A gun having a gun frame including a breech, a slidable hammer member movable from a cocked position to a firing position upon release, means for firing a projectile from said gun upon being struck by said hammer member moving to said firing position, a spring mounted to drive said slidable hammer member to its firing position, a trigger pivotally connected to said frame, means for pivoting said trigger to a forward position upon release of said trigger, an elongate sear device having first and second ends, said second end being engageable with said slidable hammer member in said cocked position, a sear pin mounted in said breech and pivotally supporting said sear device, and means for biasing said sear device so that said second end thereof is pivoted about said sear pin into engagement with said hammer member when the gun is cocked, wherein said sear device includes a sear detent slidably mounted in said first end of the device and means for biasing said sear detent to move away from the sear device in the direction of said first end in order to be engageable directly by said trigger and wherein said sear detent is forced towards said sear device in the direction of said second end thereof by direct engagement with the trigger when the trigger is pulled to a rearward position, and wherein pulling of said trigger to said rearward position causes said second end of said sear device to disengage from said hammer member, thereby releasing same.

13. A gun according to claim 12 wherein said means for biasing said sear device is a first coil spring connected at one end to said sear device and at its other end to said breech and said means for biasing said sear detent is a second coil spring mounted in a longitudinally extending hole in a first end section of the sear device.

14. A gun according to claim 12 wherein said sear device has a hole formed therein for the passage of said sear pin, said hole being elongate in the longitudinal direction of the sear device, wherein said device is able to move a short distance in the longitudinal direction of the sear device relative to the sear pin and the breech.

* * * * *